US005527365A

United States Patent [19]

Coleman et al.

[11] Patent Number: 5,527,365

[45] Date of Patent: Jun. 18, 1996

[54] IRREVERSIBLE DRYING OF CARBONACEOUS FUELS

[75] Inventors: Richard D. Coleman, Orleans; Floyd N. Toll, Russell; Bryan D. Sparks, Gloucester, all of Canada

[73] Assignee: National Research Council of Canada, Ottawa, Canada

[21] Appl. No.: 348,943

[22] Filed: Nov. 25, 1994

[30] Foreign Application Priority Data

Nov. 26, 1993 [GB] United Kingdom ..... 9324328

[51] Int. Cl.[6] ..... C10L 5/00

[52] U.S. Cl. ..... 44/626; 44/592; 44/608; 44/621

[58] Field of Search ..... 44/626, 592, 608, 44/621

[56] References Cited

U.S. PATENT DOCUMENTS

| | | | |
|---|---|---|---|
| 3,985,516 | 10/1976 | Johnson et al. | 44/626 |
| 4,309,192 | 1/1982 | Kubo et al. | 44/626 |
| 4,571,300 | 2/1986 | Schraufnagel | 44/626 |
| 4,645,513 | 2/1987 | Kubota et al. | 44/626 |
| 4,761,162 | 8/1988 | Ratcliffe et al. | 44/626 |
| 4,810,258 | 3/1989 | Greene | 44/626 |
| 4,828,576 | 5/1989 | Bixel et al. | 44/626 |
| 5,035,721 | 7/1991 | Atherton | 44/626 |
| 5,162,050 | 11/1992 | Knudson et al. | 44/626 |
| 5,256,169 | 10/1993 | Roe | 44/626 |

*Primary Examiner*—Ellen M. McAvoy

[57] ABSTRACT

The invention disclosed relates to a method for drying low-quality solid carbonaceous fuels such as lignite and sub-bituminous coal to reduce the moisture content substantially to zero, and to minimize re-adsorption of moisture during storage and transporation. The method involves drying the solid fuel in a mildly reducing atmosphere at a temperature in the range of 150°to 300° C., preferably 200°to 210° C. The mildly reducing atmosphere may be provided by a gaseous lower-alkane e.g. propane and methane. In some cases, the coal may beneficiated by agglomeration with small amounts of oil.

12 Claims, 7 Drawing Sheets

IRREVERSIBLE DRYING OF CARBONACEOUS FUELS

BACKGROUND OF THE INVENTION

1. Field of the Invention

This invention generally relates to reducing the moisture content of low-quality solid carbonaceous fuels, such as low-rank coals and the like, and more particularly to an improved process for drying such materials so that they will not re-adsorb substantial moisture when stored or transported.

Low-rank coals, such as lignite and sub-bituminous coal, usually contain relatively large quantities of water (i.e., about 10 to 50% by weight). This factor makes the economics of transporting and combusting these coals considerably more expensive than for higher rank coals. Furthermore, this high moisture content makes low-rank coals dangerous owing to the possibility of spontaneous combustion during transportation or storage. Conventional drying processes prior to transportation or storage do not solve this problem because the coal will usually regain all of or most of the moisture from the atmosphere over a relatively short period of time (one to two weeks). In some cases the readsorption of moisture causes the coal to become even more pyrophoric than prior to drying. However, because of the generally low sulfur content of these low-rank coals, their continued and increasing use may be unavoidable, owing to the increasingly stringent regulations on sulfur emissions from coal combusting installations. Therefore, there is a need for an inexpensive method for beneficiation of low-rank coals to remove moisture and improve transportation and storage characteristics which obviate or substantially reduce the above problems.

2. Description of the Prior Art

Various solutions have been proposed to address these problems outlined above. Many of these involve the use of very high temperature and pressures. The capital and energy costs associated with high pressure processes generally make them economically undesirable. For example, the Bureau of Mines process is performed at 1,500 psig, while the Koppelman processes described (for example in U.S. Pat. No. 4,052,168) require pressures of 1,000–3,000 psi with the higher pressures being preferable. These high pressure requirements also severely reduce the flexibility of these processes and increase the inherent risks and dangers associated therewith.

Also, the processes of the prior art require that the matter to be dried be subjected to the aforementioned high temperature and pressures for prolonged periods of time (referred to as residence times). For example, the Koppelman processes disclose usual residence times of from 15 minutes to one hour. These extended residence times not only increase the amount of energy input into the system, but also reduce the amount of product which can be processed over a given period of time, thereby further rendering those processes economically undesirable.

Further, such processes require specialized and expensive equipment, apparatuses, and facilities which increase capital investment and production costs, thereby further rendering those processes economically undesirable.

More recent approaches involve the use of lower temperatures and pressures, and various heat exchange gases to effect a heat transfer between the gas and the coal.

For example, U.S. Pat. No. 3,985,516, which issued 12 Oct. 1976 in the name of C. A. Johnson, teaches a process of drying low-rank coal using a warm inert (i.e. containing less than about 2% of oxygen) gas in a fluidized bed. Specific examples of the inert gas are nitrogen, carbon dioxide and flue gas. The drying gas temperatures disclosed are in the range of 250° F. up to the volatilization temperature of the coal, and preferably in the range of 400° to 500° F., at atmospheric pressure. The dry coal is then passivated against re-absorption of moisture by coating the coal with a heavy liquid hydrocarbon material. Clearly, there is no teaching or suggestion that the drying conditions per se result in irreversibly dried coal.

Also, U.S. Pat. No. 4,810,258, which issued 7 Mar. 1989 in the name of M. M. Greene, teaches the use of a superheated gaseous drying medium to irreversibly dry low-rank coals. Although it is apparent that steam is the preferred gaseous medium, nitrogen is also specifically referenced. There is also provision for the re-cycling of combustion gases back to the drying area, so that a mixture of various drying gases is involved. The temperature and pressure of the drying medium is sufficient to heat the coal to temperatures in the range of 300° to 450° F. The preferred temperature and pressure of the gaseous medium is 850° F., and 0.541 psi, respectively. Further, U.S. Pat. No. 5,035,721, which issued 30 Jul. 1991 to L. Atherton, is quite similar to ,258 in that is also uses a superheated inert (gas or steam) de-moisturizing medium. The only specific drying temperature disclosed in 850° F., at a pressure of 0.541 psi.

Also, U.S. Pat. Nos. 4,705,533 and 4,800,015 in the name of J. J Simmons disclose a drying process for low-rank coals, in which the coal is immersed in oil before the heating step. During the heating process (300°–450° F.), the oil penetrates the coal particles, replacing the expended moisture, and preventing re-absorption of moisture. The oil coating also protects the resulting material from oxidation and spontaneous combustion. There is no teaching or suggestion of the use of a gaseous drying medium.

It will be appreciated that in the Prior Art processes where oil is not used in the drying process e.g. Greene and Atherton, the drying temperatures and the inherent energy requirements still need to be quite high in order to achieve substantially irreversible drying of the low-rank coal. This is evident in Johnson, who uses lower temperatures, but then has to coat the coal with oil to avoid re-absorption of moisture.

When oil is used in the drying process along with lower temperatures as in Simmons, there is a requirement to immerse the coal in oil. Subsequently, the excess oil employed has to be removed. In the current invention coal my be beneficiated prior to drying by using an oil agglomeration process. In this approach small amounts of oil (0.5 to 2 w/w %) are added to a vigorously mixed slurry of the coal particles. This method results in uniform distribution of controlled amounts of oil on the coal particle surfaces.

SUMMARY OF THE INVENTION

According to one embodiment of the invention, a method for drying low-quality solid carbonaceous fuels is provided comprising, (a) subjecting the solid fuel to a mildly reducing environment, at a temperature of 150° to 300° C. (212° to 572° F.) at about atmospheric pressure, for a time sufficient to substantially irreversibly dry the solid fuel, and (b) removing the dried solid fuel.

DETAILED DESCRIPTION OF THE INVENTION

Figure 1:
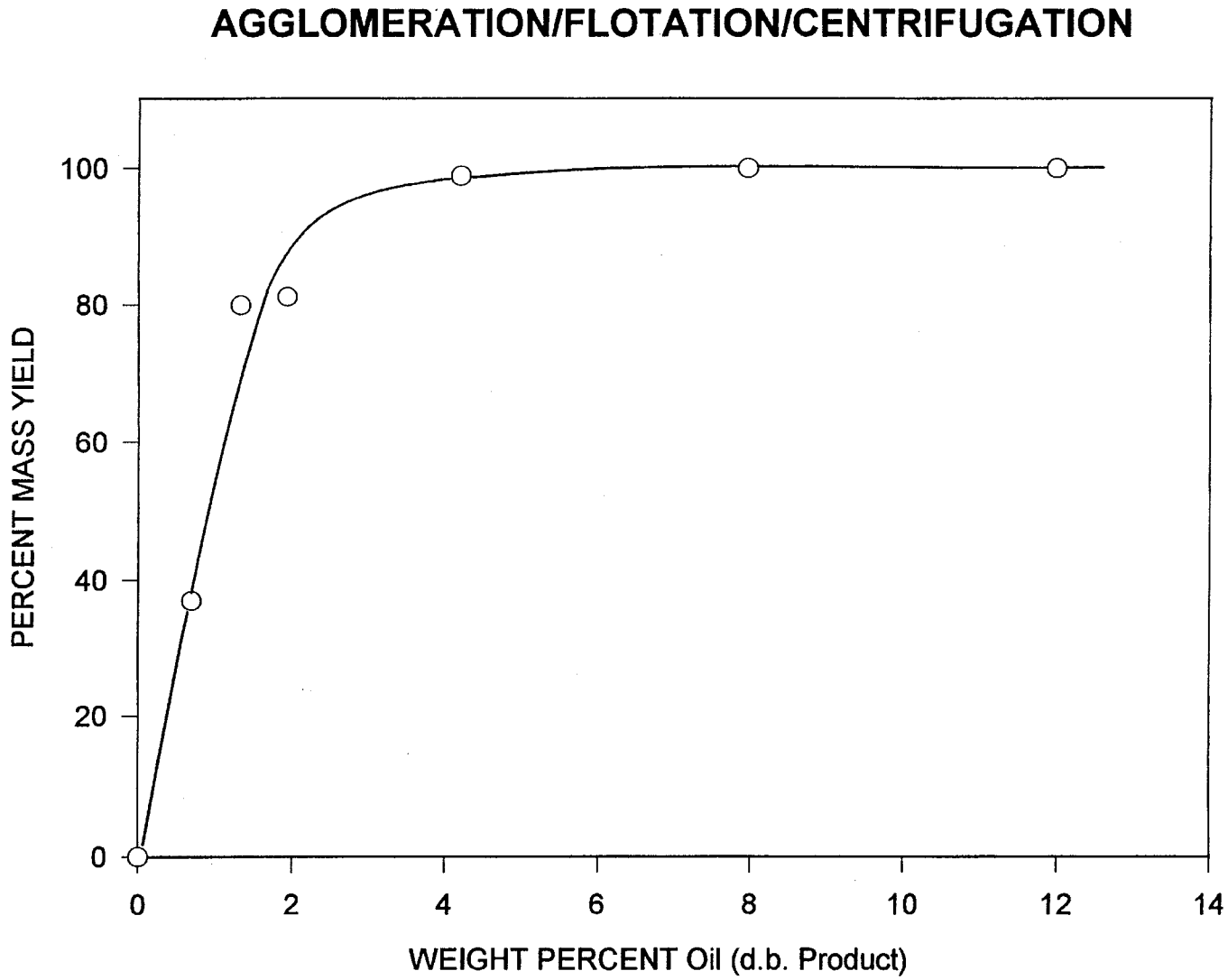
FIG. 1 is a graph illustrating the yield obtained during the oil agglomeration/flotation/centrifugation separation of floated product from unfloated residual material.

The process according to the invention is applicable to low-quality solid carbonaceous materials, such as low-rank coals e.g. sub-bituminous coals and lignite.

Applicant has now found that lower drying temperatures (302°–572° F. or 150°–300° C.), such as those employed by Johnson, can be effectively used to substantially irreversibly dry low-quality solid carbonaceous material, if used in conjunction with a mildly reducing environment. It is believed that such environment alters the hydrophilic properties of the carbonaceous material, perhaps by promoting solubilization of certain components in the material, resulting in the pores being blocked, or by favourably altering the surface composition. This reduces the re-adsorption of moisture by the material. Moreover, the resulting dry product does not require further treatment, such as by coating with oil or deactivation fluids which are required in some prior processes to reduce the risk of oxidation and spontaneous combustion. One reason for this is that our process reduces the surface oxygen content of the coal from about 39 atomic percent to about 28 atomic percent while increasing the fixed carbon—carbon contribution from about 37 atomic percent to about 46 atomic percent and minimizing formation of carboxyl groups see Tables 9 and 10.

The term "mildly reducing environment" as used herein is an environment in which the reducing conditions are not sufficient to produce a highly pyrophoric coal product, which could result from the use of certain strong reducing agents, such as hydrogen. In the latter case complete reduction of the coal occurs leaving a highly reactive surface which reoxidises in a strongly exothermic reaction when exposed to air. An example of such an environment is a suitable inert (in the sense of low oxygen content i.e below about 3% v/v of oxygen) gaseous heat exchange medium including a lower-alkane such as propane and methane.

Applicant's process may also be applied to agglomerates of low-rank coal and oil. Small amounts of a suitable oil, such as no. 2, 4 or 6 fuel oil have been employed, with no. 6 being preferred. Amounts of such oil in the range of 0.5 to 2.0% w/w/ are contemplated, with about 1.9%/w being preferred for Indonesian Adaro coal. Other, heavy oils, such as bitumen, bunker C etc may be used providing temperature is raised to produce a suitable viscosity.

Particle size of the coal used will depend on whether or not the coal is to be beneficiated prior to drying. For oil agglomeration coal particles must ground to ash liberation size of at least 60 mesh. Thermal coals requiring drying would be in lumps up to 50 mm in diameter. For the agglomeration tests a fines fraction of less than 0.6 mm was used while fractions of 3×8 mesh and <8 mesh were used in the drying tests.

EXPERIMENTAL

Materials

Three high moisture coal samples have been tested: Adaro coal, from Indonesia, Cordero mine coal and Thunder Basin coal from the Powder River basin region in the western USA.

Oil Adsorption/Agglomeration

Representative 75 gram samples of "as received" coal were added to a 1 liter Waring Blendor and diluted with fresh water to give a final volume of 500 milliliters. Blendor contents were heated to 80° C. (176° F.) with high pressure steam. Various amounts of No. 6 fuel oil were added and the mixture agitated for 30 seconds, using NRC standard high shear mixing conditions described in ("Coal Rank and Surface Properties of Oil Agglomerates", K. Darcovich, T. J. Smyth and C. E. Capes, Advanced Powder Technology 4, pp 115–128 (1993) and Coagglomeration of coal and Limestone to Reduce Suphur Emissions during Combustion", A. Majid, B. D. Sparks, C. E. Capes and C. A. Hamer, Fuel 69, pp 570–574, 1990). The contents of these two publications are incorporated herein by reference.

Contents from 2 Blendors were transferred to a 1.5 liter, stainless steel, Denver Model D-12 Flotation Cell which was operated at 1100 rpm, using only aspirated air. Float material was skimmed from the top of the cell for 3 minutes or less. Floated product and unfloated reject material were dewatered in an IEC Chemical Centrifuge, operated at about 650 G's for 1 minute. All dewatered materials were stored in tightly sealed glass bottles until heat treated or analyzed.

Drying Tests

Drying is effected to reduce the moisture content according to ASTM Standard D 3173-87. The moisture content is reduced substantially to zero, but equilibrates over time to 4 to 7% w/w of re-adsorbed moisture.

Representative samples of centrifugally dewatered, agglomerated or unagglomerated coal were placed in a furnace, or a fluidized bed, at ambient temperature. A flow of about 1 standard cubic foot per minute of air, nitrogen, propane was initiated. Sufficient time was allowed for the gas to displace any air in the furnace before raising the temperature of the atmosphere to the first test level of 110° C. (230° F.). Once the desired temperature was reached, it was maintained for 1 hour. In some cases this ended the experiment and the furnace was allowed to cool to ambient temperature while maintaining the selected furnace atmosphere. For other samples the experiment was continued after the first heating step, by raising the temperature of the atmosphere to 210° C. (410° F.) for another 1 hour. Again, the furnace and the contents were allowed to cool to ambient temperature, in the selected atmosphere. Samples were removed from the furnace and stored in tightly sealed glass jars until moisture readsorption tests or analyses were conducted.

In another series of tests samples were flushed with either air, propane or methane before being introduced into a furnace zone preheated to a temperature sufficient to raise the sample to about 200° C. in about 5 mins. The samples were maintained at this temperature for times between 5 and 120 mins. Samples were cooled rapidly to ambient temperature while maintaining the drying atmosphere. Tests were carried out in air, propane and methane.

Moisture Readsorption Tests

Representative samples of dried agglomerated or unagglomerated Adaro coal, were placed in a closed container, at ambient temperature with a water reservoir to provide a moisture saturated atmosphere. Samples were weighed at regular intervals for several days and the[ir] weight gains recorded.

A simple, qualitative assessment of the surface character of some dried samples was made by immersing them in water and assessing the floatability and degree of dispersability with time and mixing.

Air dried and total moisture analyses were conducted on oil agglomerated and unagglomerated float and sink fractions separated in the Denver Flotation Cell tests.

RESULTS AND DISCUSSION

Table 1 lists some of the physical and chemical properties of the "as received" sample of Indonesian Adaro coal. Ash and total sulphur values were very low, while the moisture content was relatively high. Volatile and fixed carbon values of this material indicated it to be a high volatile A., bituminous coal. The coal was minus 6.4 mm with 90 percent of the material being larger than 0.6 mm.

TABLE 1

CHARACTERISTICS OF INDONESIAN ADARO COAL

| Physical Characteristics | |
|---|---|
| Size | 6.4 × 0 mm<br>90% > 0.6 mm |
| Moisture (%) | |
| Air Dried | 17.4 |
| Inherent | 4.4 (35° C.) |
| TOTAL | 21.8 |
| Chemical Characteristics | |
| Volatiles (%) | 47.40 |
| Fixed Carbon (%) | 51.61 |
| Ash (%) | 0.99 |
| Sulphur (%) | 0.1 |

Table 2 shows the size analysis of Indonesian Adaro coal after a 30 second high shear mixing in the Waring Blendor. This mixing reduced the amount of plus 0.6 mm material from 90 to 45 percent of the total coal. A reduced yield or carbon recovery from the flotation separation was expected for such a size consist because of the difficulty in floating plus 0.6 mm material (1).

TABLE 2

WET SCREEN ANALYSIS OF COAL AFTER 30 SECONDS OF HIGH SHEAR MIXING IN THE BLENDOR

| SIZE (mm) | WT Percent | Volatiles (%) | Dry Ash (%) | Fixed Carbon |
|---|---|---|---|---|
| +0.6 | 45.8 | 46.50 | 0.63 | 52.87 |
| 0.6/0.15 | 42.1 | 48.30 | 1.06 | 50.64 |
| 0.15/0.045 | 8.6 | 55.20 | 3.36 | 41.44 |
| −0.045 | 3.5 | 72.21 | 19.58 | 8.21 |

Table 3 shows some of the physical and chemical properties of the No. 6 fuel oil. Extrapolation of the viscosity data indicated that the viscosity of No. 6 fuel oil at 20° C. and 80° C. was about 10,000 and 88 centistokes, respectively. Viscosities of No. 4 and No. 2 fuel oils at 20° C. wee 43 and 34 centistokes, respectively.

TABLE 3

CHARACTERISTICS OF NO. 6 FUEL OIL

| Physical Characteristics | |
|---|---|
| IBP | 95° C. |
| FBP | 575° C. |
| Residue | 54.2% |
| NMR Aromaticity | 38% |
| Specific Gravity | 0.996 |
| Viscosity | |
| 40° C. | 1068 cSt |
| 60° C. | 222 cSt |
| 70° C. | 129 cSt |
| Chemical Characteristics | |
| Ash | 0.01% |
| Sulphur | 1.72% |
| C | 87.0% |
| H | 10.0% |

It was not possible to obtain a good dispersion of No. 6 fuel oil in water at room temperature during 30 seconds of high shear mixing. Even at 80° C. the viscosity of No. 6 fuel oil was double that of No. 4 fuel oil, at room temperature, however, the 30 second high shear mixing was now sufficient to achieve a good oil in water dispersion.

Table 4 shows moisture contents and yield values for flotation product and reject fractions, after centrifugation, as a function of the amount of No. 6 fuel oil added during the agglomeration operation. Moisture content of the products varied between 26.0 and 28.4 percent, which was 4.2 to 6.6 percent higher than the total moisture of the "as received" material. This was to be expected because a substantial amount of the coal feed material was reduced in size during the high shear blending. This resulted in a larger coal surface area capable of holding more surface moisture.

TABLE 4

SUMMARY OF OIL AGGLOMERATION/FLOTATION/CENTRIFUGATION OF INDONESIAN ADARO COAL

| WT % | FLOAT PRODUCT QUALITIES AFTER CENTRIFUGATION | | FLOAT REJECT QUALITIES AFTER CENTRIFUGATION | |
|---|---|---|---|---|
| NO. 6 FUEL OIL ADDED | Moisture (%) | Yield (%) | Moisture (%) | Yield (%) |
| 0 | — | 0 | 24.3 | 100.0 |
| 0.68 | 26.0 | 37.0 | 26.0 | 63.0 |
| 1.33 | 27.2 | 79.9 | 26.0 | 20.1 |
| 1.94 | 26.1 | 81.1 | 26.5 | 18.9 |
| 4.21 | 28.1 | 98.9 | 27.2 | 1.1 |
| 7.97 | 27.5 | 100.0 | — | 0 |
| 11.99 | 28.4 | 100.0 | — | 0 |

FIG. 1 shows the yield obtained during the oil agglomeration/flotation/centrifugation separation of floated product from unfloated residual material. The original coal contained only 1 percent ash, consequently yield and carbon recovery values were virtually identical. The addition of about 0.7 percent agglomerating oil resulted in a poor flotation separation and a yield of only about 37 percent. This was reasonable as 45 percent of the coal was larger than 0.6 mm, even after the 30 second high shear mixing. As was mentioned previously, flotation of the plus 0.6 mm particles is very difficult(1). The addition of about 1.5 to 2.0 percent agglomerating oil resulted in a yield of about 80 percent. The addition of about 4 percent of more agglomerating oil resulted in a yield of 100 percent. A crushing step conducted prior to agglomeration would reduce the size of the large particles without producing an excessive amount of fines, allowing an increased product yield or carbon recovery at oil addition levels of about 2 percent. Alternatively the yield or carbon recovery for the minus 6.5 mm material could be substantially increased by replacing the flotation separation with a screening separation using a 0.15 mm screen. Oil requirements would then, be less than 1 percent. If consideration is given to using this material as feed for a coal water slurry then fine grinding would be required and larger amounts of oil needed to agglomerate the material.

Tables 5 to 8 show moisture readsorption from a water vapour saturated atmosphere by coal or coal agglomerates dried at 100° C. (230° F.) or 210° C. (410° F.) in air, nitrogen and propane, respectively.

TABLE 5

MOISTURE READSORPTION FROM A WATER SATURATED ATMOSPHERE BY "AS RECEIVED" COAL DRIED IN AIR

| SIZE FRACTION | −1 MM | +1 MM | TOTAL |
|---|---|---|---|
| Drying Temperature (°C.) | 110 | 110 | 110 |
| Readsorption Time (days) | Weight Percent Moisture Readsorption | | |
| 0 | 0 | 0 | 0 |
| 0.1 | 1.5 | 1.2 | 1.2 |
| 0.3 | 4.3 | 3.3 | 3.5 |
| 1.0 | 8.9 | 7.6 | 7.9 |
| 1.1 | | | |
| 1.3 | 9.2 | 8.0 | 8.3 |
| 2.0 | | | |
| 2.3 | 9.6 | 8.4 | 8.7 |
| 3.0 | 10.9 | 10.2 | 10.4 |
| 3.3 | 11.1 | 10.6 | 10.7 |
| 4.0 | 11.8 | 11.4 | 11.5 |
| 4.3 | 12.0 | 11.7 | 11.8 |
| 7.0 | 14.2 | 14.2 | 14.2 |
| 8.0 | 14.5 | 14.4 | 14.4 |
| 9.0 | | | |
| 10.0 | 14.7 | 14.6 | 14.6 |
| 14.0 | 15.4 | 15.0 | 15.1 |

TABLE 6

MOISTURE READSORPTION FROM A WATER SATURATED ATMOSPHERE BY HIGH SHEAR MIXED COAL DRIED IN AIR

| Weight Percent Agglomerating Oil | 0 | 0 | 1.9 |
|---|---|---|---|
| Drying Temperature (°C.) | 110 | 210 | 210 |
| Readsorption Time (days) | Weight Percent Moisture Readsorption | | |
| 0 | 0 | 0 | 0 |
| 0.1 | 0.8 | 1.2 | 1.2 |
| 0.3 | 2.1 | 3.6 | 3.4 |
| 1.0 | 5.4 | 7.7 | 7.4 |
| 1.1 | 6.7 | 7.9 | 7.7 |
| 1.3 | 7.3 | 8.2 | 7.9 |
| 2.0 | 8.8 | 9.3 | 9.1 |
| 2.3 | 9.5 | 9.6 | 9.5 |
| 3.0 | 10.6 | 10.2 | 9.9 |
| 3.3 | 10.9 | 10.3 | 10.1 |
| 4.0 | 11.4 | 10.8 | 10.5 |
| 4.3 | 11.6 | 11.0 | 10.7 |
| 7.0 | 13.2 | 11.8 | 11.2 |
| 8.0 | 13.7 | 12.0 | 11.4 |
| 9.0 | 14.0 | 12.0 | 11.5 |
| 10.0 | 14.3 | 12.2 | 11.7 |
| 14.0 | 15.1 | 12.5 | 11.9 |

TABLE 7

MOISTURE READSORPTION FROM A WATER SATURATED ATMOSPHERE BY COAL DRIED IN NITROGEN

| Weight Percent Agglomerating Oil | 0 | 0 | 0.7 | 1.3 | 1.9 | 4.2 | 8.0 | 12.0 |
|---|---|---|---|---|---|---|---|---|
| Drying Temperature (°C.) | 110 | 210 | 210 | 210 | 210 | 210 | 210 | 210 |
| Readsorption Time (days) | Weight Percent Moisture Readsorption | | | | | | | |
| 0.0 | 0.0 | 0.0 | 0.0 | 0.0 | 0.0 | 0.0 | 0.0 | 0.0 |
| 0.1 | 0.9 | 0.5 | 0.6 | 0.7 | 0.6 | 0.6 | 0.7 | 0.6 |
| 0.3 | 2.8 | 1.6 | 1.5 | 1.8 | 1.7 | 1.6 | 1.7 | 1.7 |
| 1.0 | 6.5 | 4.0 | 3.8 | 4.3 | 3.4 | 3.8 | 3.5 | 3.2 |
| 1.1 | 6.8 | 4.2 | 4.0 | 4.5 | 3.6 | 4.0 | 3.7 | 3.4 |
| 1.3 | 6.9 | 4.5 | 4.3 | 4.7 | 3.8 | 4.2 | 3.9 | 3.5 |
| 2.0 | 8.0 | 5.7 | 5.2 | 5.5 | 4.6 | 5.1 | 4.6 | 4.3 |
| 2.3 | 8.3 | 6.0 | 5.5 | 5.8 | 4.9 | 5.3 | 4.8 | 4.5 |
| 3.0 | 9.1 | 6.7 | 6.1 | 6.5 | 5.5 | 5.9 | 5.4 | 4.9 |
| 3.3 | 9.3 | 7.0 | 6.3 | 6.6 | 5.6 | 6.1 | 5.5 | 5.0 |
| 4.0 | 10.0 | 7.3 | 6.7 | 7.0 | 5.9 | 6.4 | 5.7 | 5.3 |
| 4.3 | 10.2 | 7.5 | 6.8 | 7.1 | 5.9 | 6.5 | 5.7 | 5.3 |
| 7.0 | 11.4 | 8.6 | 7.6 | 8.0 | 6.8 | 7.2 | 6.4 | 5.9 |
| 8.0 | 11.6 | 8.8 | 7.8 | 8.2 | 7.i | 7.4 | 6.6 | 6.1 |
| 9.0 | 11.8 | 9.0 | 8.0 | 8.2 | 7.2 | 7.5 | 6.7 | 6.2 |
| 10.0 | 11.8 | 9.2 | 8.1 | 8.4 | 7.3 | 7.6 | 6.8 | 6.2 |

TABLE 7-continued

| MOISTURE READSORPTION FROM A WATER SATURATED ATMOSPHERE BY COAL DRIED IN NITROGEN | | | | | | | | |
|---|---|---|---|---|---|---|---|---|
| Weight Percent Agglomerating Oil | 0 | 0 | 0.7 | 1.3 | 1.9 | 4.2 | 8.0 | 12.0 |
| Drying Temperature (°C.) | 110 | 210 | 210 | 210 | 210 | 210 | 210 | 210 |
| Readsorption Time (days) | Weight Percent Moisture Readsorption | | | | | | | |
| 14.0 | 12.3 | 9.8 | 8.5 | 8.9 | 7.6 | 7.9 | 7.0 | 6.4 |

TABLE 8

| MOISTURE READSORPTION FROM A WATER SATURATED ATMOSPHERE BY COAL DRIED IN PROPANE | | | | |
|---|---|---|---|---|
| Weight Percent Agglomerating Oil | 0 | 1.9 | 0 | 1.9 |
| Drying Temperature (°C.) | 110 | 110 | 210 | 210 |
| Readsorption Time (days) | Weight Percent Moisture Readsorption | | | |
| 0.0 | 0.0 | 0.0 | 0.0 | 0.0 |
| 0.1 | 0.7 | 0.9 | 0.3 | 0.5 |
| 0.3 | 2.1 | 2.7 | 0.9 | 1.3 |
| 1.0 | 5.2 | 6.0 | 2.7 | 3.0 |
| 1.1 | 5.6 | 6.3 | 2.9 | 3.2 |
| 1.3 | 6.0 | 6.7 | 3.2 | 3.4 |
| 2.0 | 7.5 | 7.9 | 4.0 | 4.0 |
| 2.3 | 7.9 | 8.2 | 4.2 | 4.2 |
| 3.0 | 8.8 | 8.9 | 4.8 | 4.7 |
| 3.3 | 9.1 | 9.0 | 4.9 | 4.7 |
| 4.0 | 9.9 | 9.7 | 6.4 | 5.2 |
| 4.3 | 10.2 | 9.8 | 5.5 | 5.3 |
| 7.0 | 11.5 | 10.9 | 6.6 | 5.7 |
| 8.0 | 11.8 | 11.1 | 6.8 | 5.9 |
| 9.0 | 12.0 | 11.2 | 6.9 | 6.0 |
| 10.0 | 12.2 | 11.3 | 7.1 | 6.1 |
| 14.0 | 12.7 | 11.8 | 7.4 | 6.3 |

Figure 2:
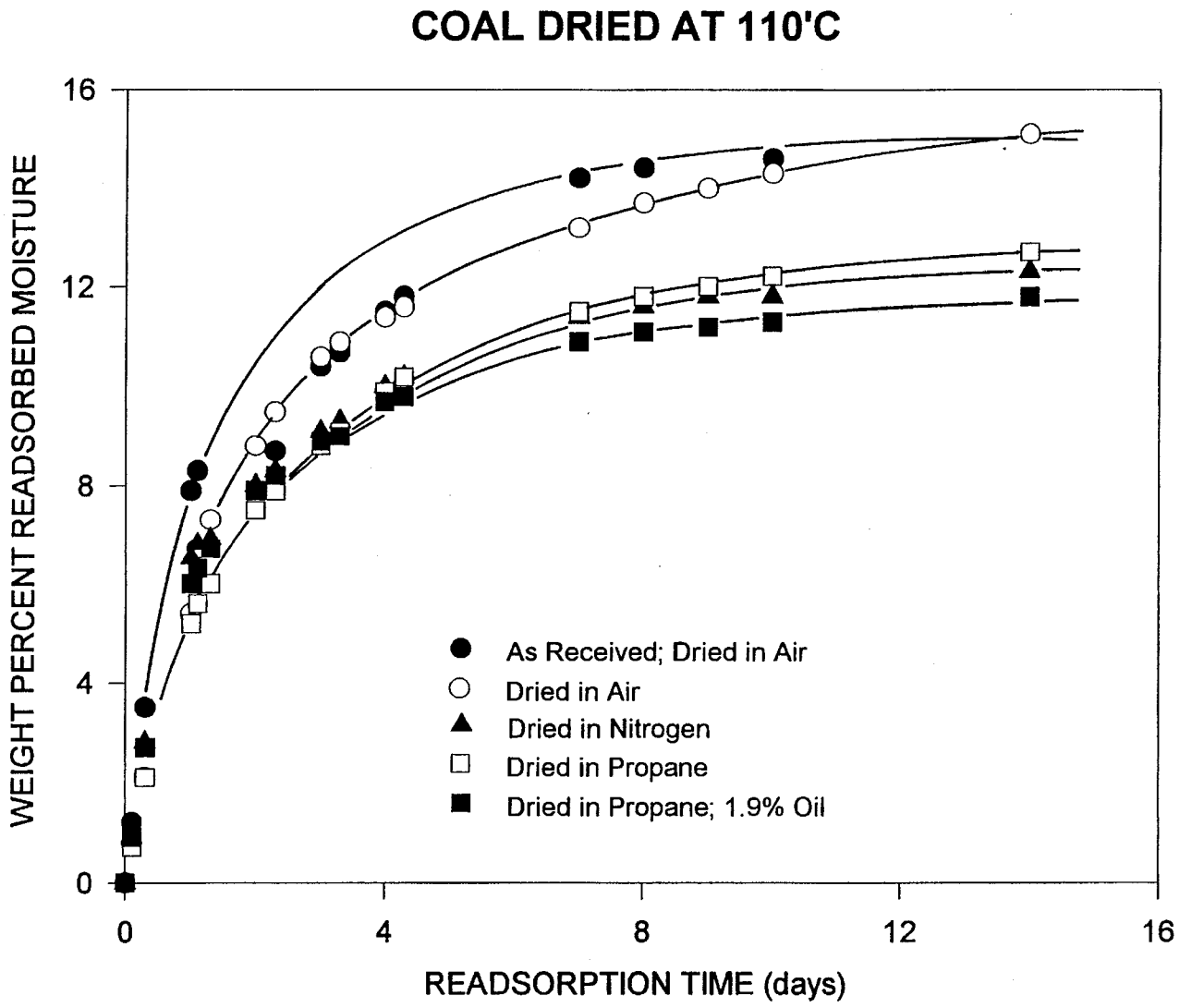
FIGS. 2 to 4 are graphs illustrating the amount of moisture re-absorbed as a function of time, under various conditions, for a typical low-rank coal.

FIG. 2 shows the weight percent moisture readsorbed as a function of time for coal samples dried at 110° C. (230° F.) in atmospheres of air, nitrogen and propane. Essentially, there was no difference between the moisture readsorption curves for the "as received" and the blended coal, dried in air. Both reached an equilibrium moisture content of about 15 percent after 2 weeks even through the particle size distribution of these two coal samples was very different. Similarly, samples dried in nitrogen and propane reached equilibrium moisture contents of about 13 and 12.5 percent, respectively. One test was conducted in a propane atmosphere, using agglomerates containing about 1.9 percent oil. In this case the equilibrium moisture content of this sample was about 12 percent. These tests demonstrated an important effect of drying atmosphere on moisture readsorption. With a mildly reducing atmosphere, moisture readsorption was reduced from 15 to 13 percent. The presence of about 1.9 percent agglomerating oil on the coal surface, during drying at 110° C. (230° F.) in propane reduced moisture readsorption even further.

Figure 3:
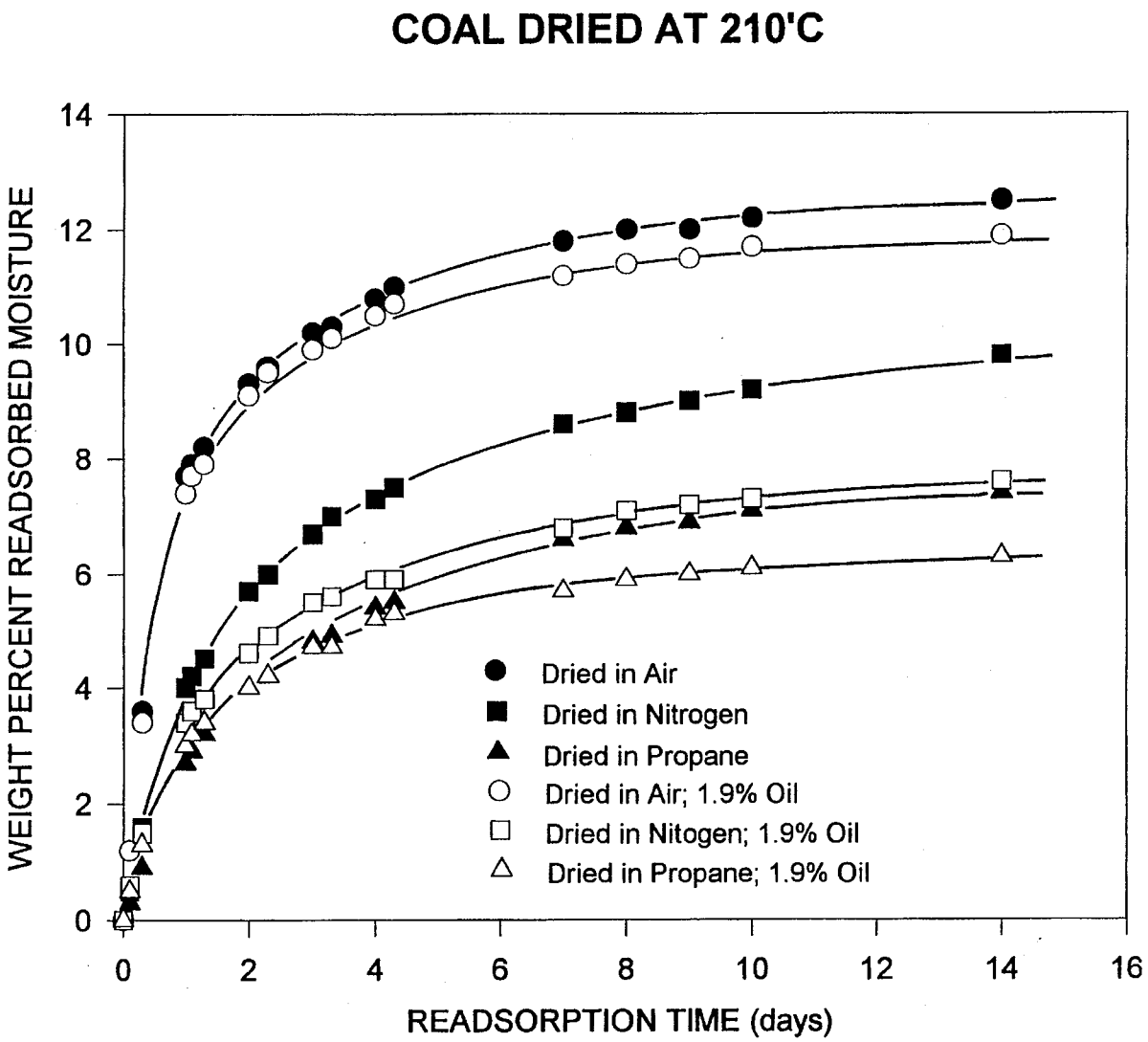

FIG. 3 shows the weight percent moisture readsorbed as a function of time, for coal and coal agglomerate samples dried at 210° C. (410° F.) in air, nitrogen and propane atmospheres. All samples heated to 210° C. (410° F.) had been maintained at 110° C. (230° F.) for 1 hour, prior to increasing the temperature to 210° C. (410° F.). In all cases the dried coal samples had reached near equilibrium moisture contents after 14 days of exposure to a saturated atmosphere. Samples dried in air, nitrogen and propane readsorbed moisture to levels of 12.5, 9.8 and 7.4 percent, respectively. These values were significantly less than those obtained by drying at 110° C. (230° F.). At 210° C. (410° F.), the presence of 1.9 percent oil in the coal further reduced the amount of water readsorbed. Samples of oiled agglomerates dried in air, nitrogen and propane had equilibrium moisture contents of 11.9, 7.6 and 6.3 percent, respectively. These results indicated that moisture readsorption by either unagglomerated coal or agglomerate formed with about 2 percent oil, was strongly influenced by the drying atmosphere. Agglomerates dried in propane readsorbed only 54 percent as much moisture as the agglomerate dried in air.

Figure 4:
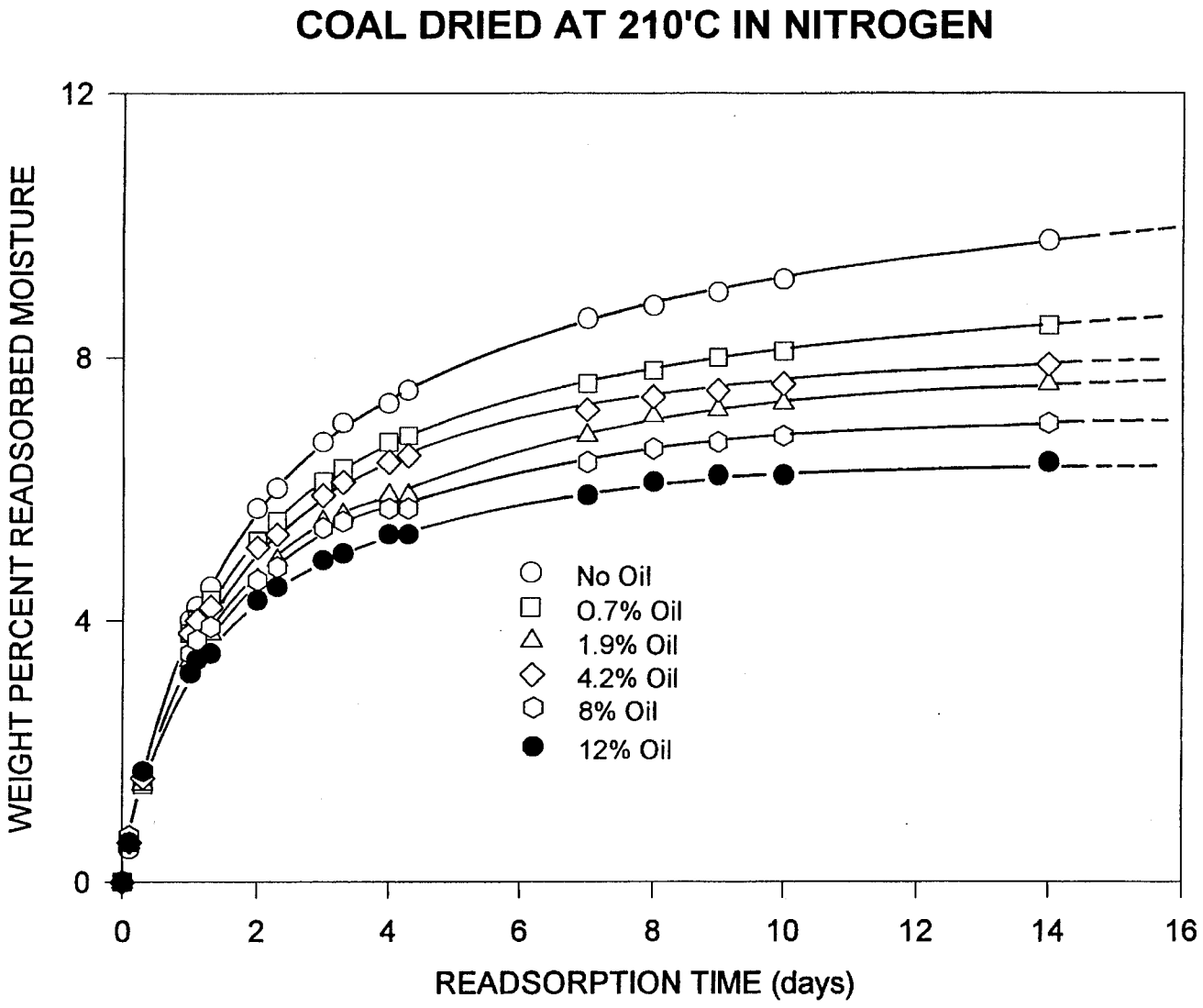

FIG. 4 (410° F.) shows the weight percent moisture readsorbed as a function of time for coal samples containing various amounts of agglomerating oil. All samples were dried at 210° C. (410° F.) in nitrogen. As expected moisture readsorption was inversely proportional to the amount of oil used for agglomeration. A substantial reduction in readsorbed moisture was achieved even when only 0.7 percent agglomerating oil was employed. However, at this oil level yield or carbon recovery from the flotation separation was only 37 percent. In this case, if one assumed the oil to be uniformly dispersed and the coal particles uniformly coated, according to relative surface area, then most of the oil was adsorbed on the finest material, which had the largest surface area. Thus, the recovered coal particles from the flotation operation had larger amounts of oil associated with them, on a weight basis, than the larger, unfloated reject material. The larger amount of oil associated with the smaller amount of recovered coal may have been responsible for the observed, unexpected, substantial moisture readsorption reduction. In addition, the rejection of the majority of ash during agglomration may also have contributed to a smaller moisture readsorption value. At an agglomerating oil level of about 2 percent the equilibrium readsorbed moisture was about 7.0 percent, a readsorbed moisture content reduction of about 30 percent compared to the coal sample containing no oil. As agglomerating oil levels increased from about 2 percent, progressive marginal moisture readsorption reductions occurred. However, the cost of oil is too high for additions of more than about 2% to be a valid option.

Figure 5:
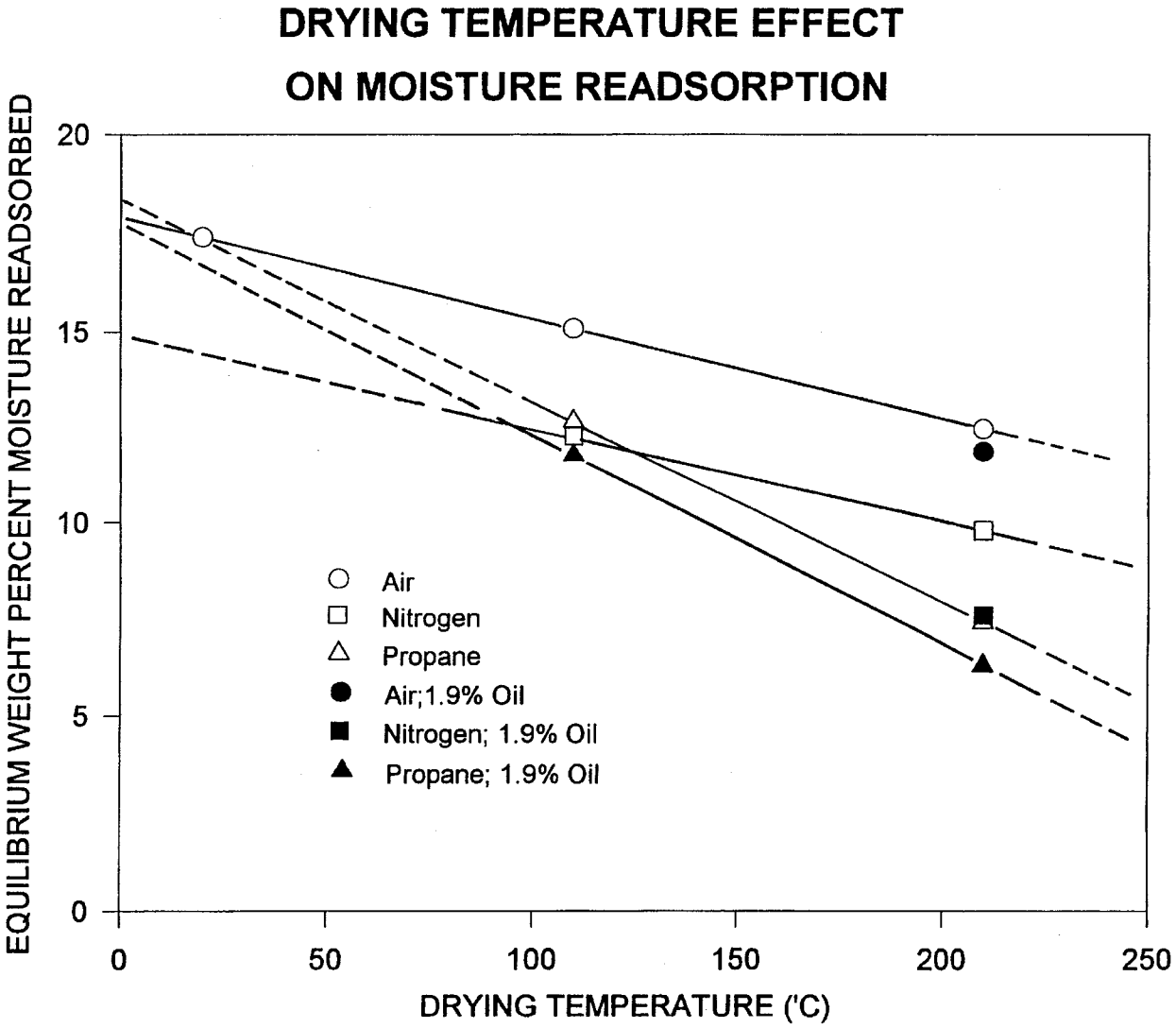
FIG. 5 is a graph illustrating the amount of moisture re-adsorbed as a function of drying temperature, for the same low-rank coal.

FIG. 5 shows the equilibrium weight percent moisture readsorbed by coal and agglomerate samples as a function of drying temperature. Samples were dried in air, nitrogen and propane. As the drying temperature was increased, the readsorbed equilibrium moisture content of the coal and agglomerates decreased. Over the temperature range studied, the relationships appeared to be linear and the slopes of the drying temperature curves for samples dried in air and nitrogen were similar. Slopes for the drying temperature curves for the samples dried in propane were greater than those obtained for air or nitrogen. This suggested that effect of drying atmosphere was very important.

Figure 6:
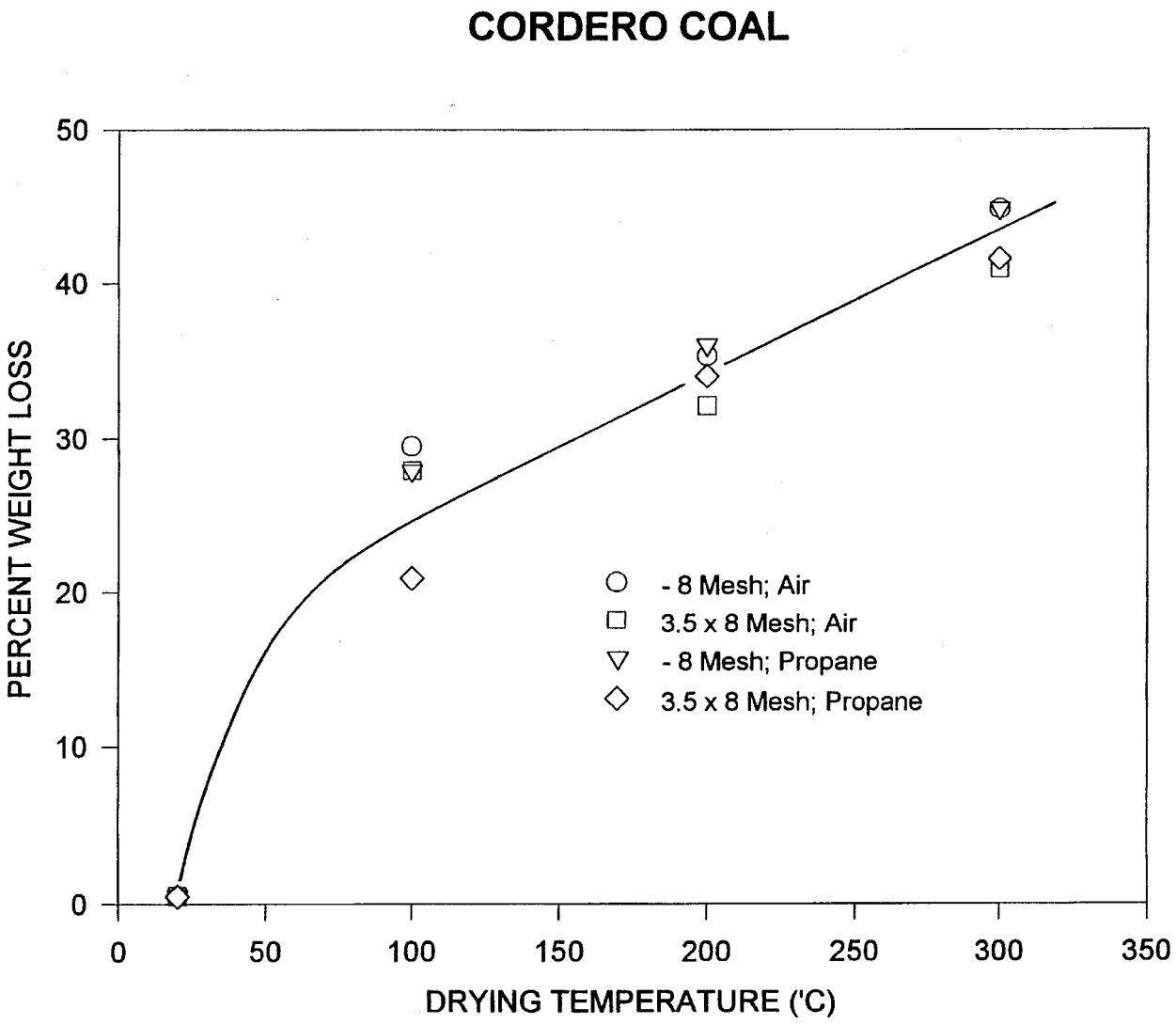
FIGS. 6 and 7 are graphs illustrating the effects of different particle sizes of another typical low-rank coal.
Figure 7:
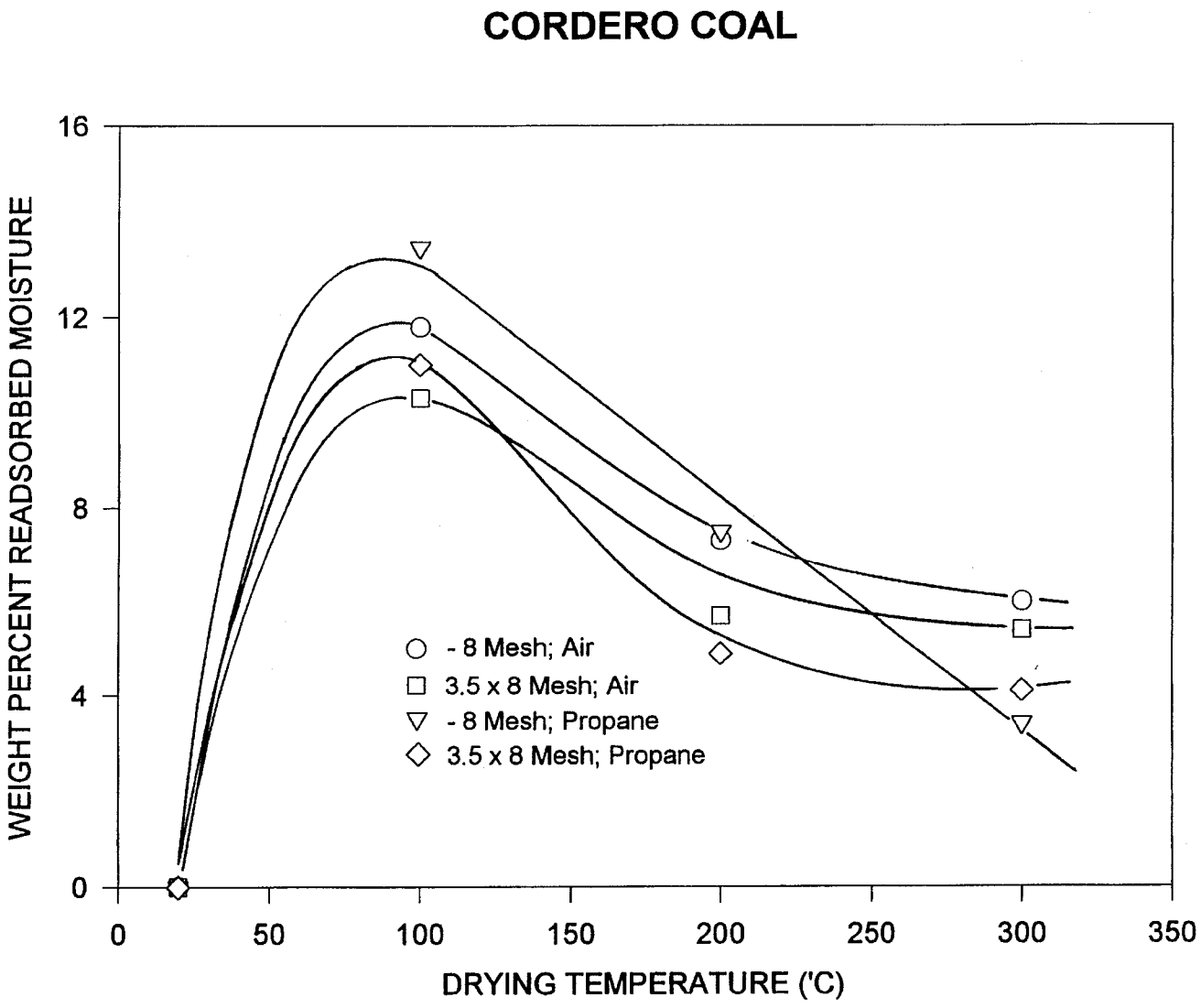

FIG. 6 shows the weight loss vs drying temperature curve for a coal sample from the Cordero mine. Weight loss continues beyond 110° C. (230° F.) indicating that some volatiles are also lost during heating to higher temperatures. Moisture content is in the 20 to 30 w/w % range as determined by weight loss at 110° C. FIG. 7 shows the moisture readsorption curve for samples heated up to 300° C. (572° F.). FIG. 7 illustrates the pick-up of moisture from a saturated atmosphere is consistent with the previous results and shows that the effect can be extended to temperatures higher than 210° C. (410° F.). Again samples dried in a propane atmosphere showed the lowest readsorption.

Summary of XPS data for coal samples dried in air and propane at different temperatures.

TABLE 9

Gross Surface Analysis for Carbon and Oxygen

| Sample | Temperature | Time | Atmosphere | Surface Composition C | Surface Composition O |
|---|---|---|---|---|---|
| Raw Coal | Undried | NA | NA | 53.0 | 38.6 |
| Raw Coal | 110 | 60 | Air | 52.6 | 36.5 |
| 3.5 × 8 mesh | 210 | 60* | Air | 79.4 | 17.3 |
| <8 mesh | 210 | 60* | Air | 71.4 | 22.7 |
| 3.5 × 8 mesh | 110 | 60 | Propane | 52.5 | 38.8 |
| <8 mesh | 110 | 60 | Propane | 54.6 | 37.1 |
| 3.5 × 8 mesh | 210 | 60* | Propane | 66.4 | 27.6 |
| <8 mesh | 210 | 60* | Propane | 59.2 | 32.8 |

TABLE 10

Chemical Group Types by XPS Analysis

| Sample Description | Drying Conditions | Major Surface Groups (Atomic Percent) —OH, —C—O—C— | —COOH | —C—C— |
|---|---|---|---|---|
| Raw Coal | Undried | 4.4 | ND | 36.7 |
| Raw Coal | 110° C. in air | 3.2 | 4.3 | 38.3 |
| 3.5 × 8 mesh | 110° C. in propane | 3.2 | ND | 46.1 |
| <8 mesh | 110° C. in propane | 4.1 | 1.8 | 40.1 |
| 3.5 × 8 mesh | 210° C.* in air | 4.3 | 5.3 | 56.0 |
| <8 mesh | 210° C.* in air | 4.8 | 5.1 | 51.6 |
| 3.5 × 8 mesh | 210° C.* in propane | 3.3 | 2.4 | 46.0 |
| <8 mesh | 210° C.* in propane | 4.0 | 2.4 | 42.3 |

Note: *Samples were heated to 110° C. for 60 min. then ramped to 210° C. and maintained at that temperature for an additional 60 min.

METHOD

A Kratos XPS instrument was used with charge neutralization and monochromated Al $K_a$ radiation. A survey inspection was run on each sample and then the areas of interest were analyzed at high resolution. Surface compositions of a layer 75 μ thick are reported in atomic percent; hydrogen is not analyzed. Each value is an average of single measurements made at 3 or 4 different areas on individual samples.

DISCUSSION

From Table 9 we see that surface analysis shows no significant changes in the gross carbon and oxygen contents after drying in either air or propane at 110° C. Additional heating to 210° C. results in a large increase in fixed carbon and a corresponding decrease in oxygen content for air, nitrogen and propane atmospheres. These results show that heating per se results in the loss of surface oxygen. Such a reduction would be expected to result in a more hydrophobic, or moisture repellant, surface. In fact, consideration of Tables 6, 7 and 8 shows that in each case moisture readsorption from a saturated atmosphere is less for the samples heated at 210° C. compared to those dried at 110° C. The sample dried in air at 110° C. readsorbed all the moisture that had been removed by drying.

The results in Table 10 were produced by devolution of the XPS spectra for carbon into chemical group types. In particular —C—C—, —OH, —C—O—C and —COOH groups have been identified; of these groups the carboxyl is most important in terms of water avidity, while carbon—carbon bonds are associated with water repellant surface characteristics. The original, undried coal contains no measurable amount of carboxyl groups. Heating at 110° C. in propane has no effect on surface composition while heating in air results in a large increase in surface carboxyl concentration. Heating at higher temperatures resulted in the production of carboxyl groups in every case, however, the amounts were significantly higher when the coal samples were heated in air rather than propane. Heating at temperatures of the order of 200° C. resulted in an overall loss of surface oxygen from the coal. At the same time the surface concentration of carboxyl groups increases, especially for those samples heated in air while —C—C— bonding only increases for those samples heated in propane. The differences in water adsorption by the samples dried in different atmospheres and temperatures is associated with an increase in carboxyl concentration for air dried samples and a combination of carboxyl formation suppression and carbon—carbon enhancement for the samples dried in propane.

A series of tests at different drying times have also been carried out in both air, propane and methane. The surface condition of each sample was qualitatively assessed by mixing the dried coal with water. The air dried samples could all be more or less dispersed in water while samples heated in propane for more than 5 minutes were much more difficult to disperse. Methane exhibited characteristics intermediate to these extremes. This simple test indicates that the desired surface changes, to produce a more hydrophobic material can be achieved by heating for between 5 and 15 minutes at about 200° C.

We claim:

1. A method for drying low-quality carbonaceous fuels, consisting essentially of (a) subjecting a solid carbonaceous fuel to a mildly reducing environment, at a temperature of 150° to 300° C. at about atmospheric pressure, for a time sufficient to substantially irreversibly dry the solid fuel, and (b) removing the solid fuel.

2. A method according to claim 1, wherein the mildly reducing environment is effected by providing an inert gaseous heat exchange medium including a lower-alkane.

3. A method according to claim 2, wherein the gaseous heat exchange medium is selected from the group consisting of propane and methane.

4. A method according to claim 3, wherein the gaseous heat exchange medium is propane.

5. A method according to claim 3, wherein the temperature is 200°–210° C.

6. A method according to claim 5, wherein the carbonaceous fuel is a low-rank coal.

7. A method according to claim 5, wherein the coal is selected from the group consisting of lignite and subituminous coal.

8. A method according to claim 6, wherein prior to step (a), the coal is agglomerated with oil, in amount of 0.5 to 2 % w/w.

9. A method according to claim 8, wherein the particle size of the coal is 0.15 to 0.6 mm, with about 45% being larger than 0.6 mm.

10. A method according to claim 9, wherein the amount of oil is about 2% w/w.

11. A method according to claim 10, wherein the oil is selected from the group consisting of no. 2, no. 4 and no. 6 fuel oil.

12. A method according to claim 6, wherein step (a) is effected for 5 to 15 minutes.

* * * * *